United States Patent [19]

Stahlecker

[11] Patent Number: 5,005,348

[45] Date of Patent: Apr. 9, 1991

[54] PROCESS AND AN ARRANGEMENT FOR PRODUCING PACKAGES

[75] Inventor: Fritz Stahlecker, Bad Überkingen, Fed. Rep. of Germany

[73] Assignee: Hans Stahlecker, Fed. Rep. of Germany; a part interest

[21] Appl. No.: 539,305

[22] Filed: Jun. 18, 1990

Related U.S. Application Data

[63] Continuation of Ser. No. 340,708, Apr. 20, 1989, abandoned.

[30] Foreign Application Priority Data

Apr. 21, 1988 [DE] Fed. Rep. of Germany ..... 3813368

[51] Int. Cl.[5] ..... D01H 1/115; D01H 1/20

[52] U.S. Cl. ..... 57/87; 57/84; 57/328; 57/350

[58] Field of Search ..... 57/80, 84, 86, 87, 261, 57/264, 313, 328, 350

[56] References Cited

U.S. PATENT DOCUMENTS

| | | | |
|---|---|---|---|
| 1,850,207 | 3/1932 | Hyde | 57/80 |
| 2,494,490 | 1/1950 | Rienhart et al. | 57/86 |
| 3,759,026 | 9/1973 | Hope | 57/80 |
| 4,121,409 | 10/1978 | Uchida et al. | 57/261 X |
| 4,219,998 | 9/1980 | Farnhill | 57/350 X |
| 4,276,740 | 7/1981 | Chambley et al. | 57/350 X |
| 4,484,436 | 11/1984 | Nakayama et al. | 57/328 |
| 4,495,758 | 1/1985 | Stahlecker et al. | 57/87 X |
| 4,545,193 | 10/1985 | Tanaka et al. | 57/328 X |
| 4,559,773 | 12/1985 | Stahlecker | 57/261 |
| 4,619,109 | 10/1986 | Suzuki et al. | 57/328 X |

FOREIGN PATENT DOCUMENTS

| | | |
|---|---|---|
| 3606932 | 9/1987 | Fed. Rep. of Germany . |
| 3805338 | 8/1989 | Fed. Rep. of Germany . |
| 1015291 | 12/1965 | United Kingdom . |

*Primary Examiner*—Joseph J. Hail, III

*Attorney, Agent, or Firm*—Evenson, Wands, Edwards, Lenahan & McKeown

[57] ABSTRACT

In the case of a process for producing packages used as feeding packages for twisting, it is provided that two prestrengthened yarn components are wound up side-by-side as a double yarn. If one yarn component breaks, the winding-up is interrupted. The unbroken yarn component is gripped and held ready at a given point so that it may be taken up for a piecing and wound off the partially wound spool, while taking along the broken yarn component from the partially wound spool.

28 Claims, 6 Drawing Sheets

PROCESS AND AN ARRANGEMENT FOR PRODUCING PACKAGES

This is a continuation of application Ser. No. 07/340,708, filed Apr. 20, 1989, now abandoned.

BACKGROUND AND SUMMARY OF THE INVENTION

The invention relates to a process and an arrangement for producing packages used as feeding packages for twisting, onto which two prestrengthened Yarn components are wound side-by-side as a double yarn, these yarn components, each being drafted and subsequently, in each case, false-twisted, and then guided together and wound onto the spool as a double yarn.

In a process of the initially mentioned type, such as disclosed in German Published Examined Application DE-A 36 06 932, corresponding to U.S. Pat. No. 4,761,946, it is possible that one of the two yarn components may break. It should then be avoided that the remaining yarn component is wound onto the partially wound spool alone, because this may interfere considerably with the subsequent spinning operation. It is therefore provided that, in the case of a breakage of one yarn component, the other yarn component also is cut. This approach may be sufficient for manual spinning, in which the operator searches for the broken yarn end and for the cut yarn end on the partially wound spool and subsequently withdraws the double yarn from the partially wound spool for a piecing operation. Since, as a rule, it must be assumed that the two yarn components do not have the same length, and that therefore the ends of the yarn components are located at different points on the circumference of the partially wound spool, considerable difficulties arise for an automatic piecing arrangement which must then search for and take up two yarn ends.

In order to solve this problem for an automatic piecing arrangement, it was suggested in an older patent application, German application (P 38 05 338.1), corresponding U.S. application Ser. No. 311,731, filed Feb. 17, 1989, which is no prior publication, that, when one yarn component breaks, both yarn components are jointly cut in the area in which they are still both present. As a result, it is achieved that the two ends of both yarn components are located at the same point. It is also suggested that, when one yarn component breaks, the partially wound spool is stopped before the broken end has moved onto the partially wound spool. Both solutions permit an automatic finding and rewithdrawing of the two yarn components from the partially wound spool in order to then carry out a piecing.

An object of this invention is to provide a process and an arrangement of the initially mentioned type, where it is possible, after a breakage of only one yarn component, to find both yarn components also by means of an automatic piecing arrangement and wind them off the partially wound spool for a piecing process.

This object is achieved in that, when one yarn component breaks, the winding-on is interrupted, the unbroken yarn component being gripped and held ready at a given point, after which, for the purpose of piecing, the unbroken yarn component is taken up and wound off the partially wound spool, this unbroken yarn component taking along the broken yarn component.

The invention is based on the recognition that both yarn components break simultaneously only in negligibly few special cases, so that, in these special cases, the piecing can be carried but at least partially by an operator. The interruption of the winding-on prevents that the end of the broken yarn component is rolled into the body of the partially wound spool. The unbroken yarn component is located in a known position so that it can be taken up easily by an automatic piecing device and wound off the partially wound spool. Since a certain connection exists between the two yarn components, and since the end of the broken yarn component is not rolled into the body of the partially wound spool, the broken yarn component, when the unbroken yarn component is wound off, can also be wound off without any difficulty.

In a further development of the invention, it is provided that, when one yarn component breaks, the broken yarn component is connected with the remaining yarn component. This additional connection provides further assurance that the remaining yarn component, during a winding-off, takes along the end of the broken yarn component and also winds off this broken yarn component during a winding-off operation.

In a further development of preferred embodiments of the invention, it is provided that, when one yarn component breaks, the cross-winding is interrupted. As a result, it is ensured that the end of the broken yarn component does not move away from the remaining yarn component as a result of the cross-winding motion.

In a further development of preferred embodiments of the invention, it is provided, in the case of an arrangement for producing packages used as feeding packages for twisting having two yarn components, which are wound up side-by-side, having devices for drafting, having devices for false-twisting, having devices for the guiding-together of the yarn components, and having devices for the winding-up of the guided-together yarn components, that devices for interrupting the operation of the devices for the winding-up are provided, which are controlled by devices for monitoring the yarn components with respect to breakage, and that devices are present for gripping the unbroken yarn component and holding it ready.

In a further development of preferred embodiments of the invention, the devices for the gripping and the holding-ready are constructed as a clamping device. In this construction, it must be provided that the actuating of the devices for the gripping and the holding-ready is coordinated with the stoppage of the partially wound spool, so that the remaining yarn component is not torn.

In another development of preferred embodiments of the invention, it is provided that the devices for the gripping and the holding-ready contain at least one suction nozzle. A suction nozzle of this type can take up the remaining yarn component in the form of a yarn loop which holds the yarn component only relatively lightly, so that it can still be withdrawn from the possibly still running-down partially wound spool.

As a rule, it will be provided that the continuous supply of the remaining yarn component is interrupted as soon as the partially wound spool has come to a stop. In order to avoid that too much fiber material is lost when one yarn component breaks, it is expediently provided to stop the partially wound spool as early as possible. This may take place by providing devices for lifting the partially wound spool off a driving device. In addition, in a further development of the invention, devices may be provided for braking the partially wound spool. These devices may, for example, be applied to the face of the partially wound spool or to the sleeve of the partially wound spool onto which the double yarn is wound. It is also contemplated to introduce a plate or a piece of sheet metal between the wind-up roller and the spool for a lifting and simultaneous braking of the partially wound spool.

Other objects, advantages and novel features of the present invention will become apparent from the following detailed description of the invention when considered in conjunction with the accompanying drawings.

DETAILED DESCRIPTION OF THE DRAWINGS

Figure 1:
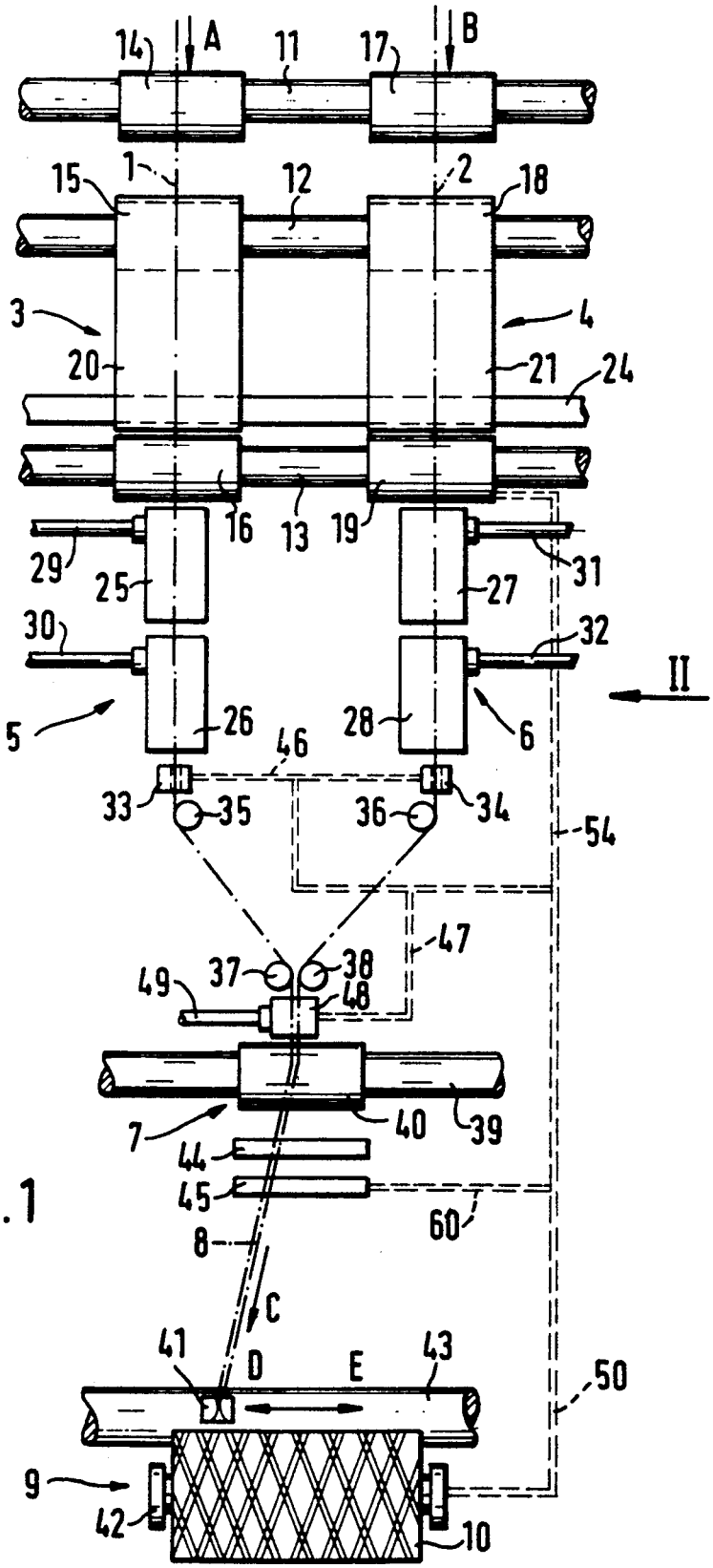
FIG. 1 is a schematic view, from the direction of the operating side, of an arrangement constructed according to a preferred embodiment of the invention for carrying out the process according to the invention, during the normal spinning operation.

In the drawings, in each case, only one arrangement or spinning unit is shown of a spinning machine which consists of a plurality of arrangements of this type arranged in a row next to one another on one side of a corresponding machine.

The arrangement shown in FIGS. 1 to 4 is used for prestrengthening two yarn components 1, 2 and, as a double yarn 8, winding them onto a spool package 10, which subsequently, in an arrangement which is not shown, is used as a feeding package for twisting. The double yarn 8, which was formed by the two prestrengthened yarn components 1, 2, will then become a twisted yarn, which only then will represent the finished fiber yarn structure which can be processed further.

The two yarn components 1, 2, enter into two drafting units 3, 4, as slivers. Drafting units 3, 4 are arranged next to one another and extend in parallel to one another, and facilitate drawing or drafting of the yarn components 1, 2 until they have the desired size. The yarn components 1, 2, which move in the direction of the arrows (A and B), will then enter into false-twisting devices 5, 6, behind which they are guided together and are withdrawn by means of a common withdrawal device 7 as a double yarn 8, which moves in the direction of arrow C to a wind-up device 9, by which the double yarn 8 is wound up to a cross-wound package 10.

The drafting units 3, 4 contain common bottom cylinders 11, 12, 13 which are driven at the machine end and to which pressure rollers 14, 15, 16 are in each case assigned on one side, and pressure rollers 17, 18, 19 are assigned on the other side. The drafting units 3, 4 contain conventional apron guides consisting of top aprons 20, 21 and bottom aprons 22, 23 which are guided around deflecting rails 24. The pressure rollers (14 to 19) are constructed as so-called twin pressure rollers, which are held in a common load carrier 58, which can be pivoted around a stationary shaft 59 extending in parallel with respect to the bottom rollers 11, 12, 13.

The false-twisting devices 5, 6 each contain two air nozzles 25, 26; 27, 28, which are arranged behind one another and are connected to compressed-air feeding lines 29, 30, 31, 32. The air nozzles 25, 27, which are first in each case, in the travel direction (A, B) of the yarn, are constructed as intake nozzles. The second air nozzles 26, 28, which follow, are the actual false-twisting nozzles which provide each of the yarn components 1, 2 with a false twist. This false twist in the yarn components 1, 2 extends back against the travel directions (A and B) of the yarn, to the delivery rollers 13, 16; 13, 19 of the drafting units 3, 4, so that the yarn components 1, 2, in this area, have a relatively high strength and are protected against yarn breakage. In the area of the air nozzles 26, 28, this false twist, which is used as a protective twist, opens up again so that the yarn components 1, 2, as a result of fiber ends which remain wound around them, have only a residual strength or a so-called prestrengthening. In this area, there is then a relatively high risk of a yarn breakage. For this reason, yarn guards 33, 34 are arranged in the area behind the air nozzles 26, 28, these yarn guards 33, 34 being each assigned to one yarn component 1,2. Behind the yarn guards 33, 34, the yarn components 1, 2 travel over yarn guides 35, 36 and are subsequently guided together by means of additional yarn guides 37, 38, such that they move along closely next to one another and in parallel to one another. The two yarn guides 37, 38 guide the two yarn components 1, 2 together in such a manner that, starting from this point, they form the double yarn 8.

As the withdrawal device 7, a shaft 39 is provided which extends through in longitudinal direction of the machine and is driven at the machine end, a pressure roller 40 being assigned to this shaft 39 at each arrangement. The withdrawal device 7 affects the double yarn 8.

A cross-winding yarn guide 41 is assigned to the wind-up device 9 and moves to and fro in the direction of the double arrow (D, E) transversely in front of the partially wound spool package 10. The spool package 10 is held by means of a spool package holder 42 which is only outlined and, in the operating condition, rests on a roller 43 which extends through in the longitudinal direction of the machine and is driven at the machine end. In order to compensate for the cross-winding motion without creating unacceptably high tensions in the double yarn 8, a compensating device in the form of two deflecting guides 44, 45, which preferably are constructed as pulleys, is provided between the cross-winding yarn guide 41 and the withdrawal device 7. The deflecting guide 45, which faces the cross-winding yarn guide 41, is stationary, whereas the deflecting guide 44 is moved synchronously to and fro with the movement of the cross-winding yarn guide 41 in the direction of the arrows (F, G) with respect to the movement of the yarn.

The yarn guards 33, 34 control different elements, as indicated by means of dotted connecting lines 46, 47, 50, 54, 60. It should be pointed out in this respect that the representation selected in the drawings is simPlified, and that the yarn guards 33, 34 are constructed as signal generators and are connected to a control apparatus which, in turn, controls the individual elements in the manner that will be explained in the following.

Between the yarn guides 37, 38 and the withdrawal device 7, a device 48 is arranged by means of which the two yarn components 1, 2 can be connected with one another. In the shown embodiment, an air nozzle is provided as this device 48, which is connected to a compressed-air supply line 49, the double yarn 8, which is formed from the two yarn components 1, 2, passing through this air nozzle, and this air nozzle, as needed, establishing a connection between the two yarn components 1, 2. It is provided, for example, that the air nozzle is continuously acted upon by compressed air and continuously tries to apply a slight false twist on the double yarn which opens up again behind this air nozzle. As long as the two yarn components 1, 2 are present and are stretched between the yarn guides 37, 38 and the withdrawal device 7, this air nozzle has practically no effect. However, should one of the two yarn components 1, 2 break, this yarn component is wound around the remaining yarn component, so that a winding-around is caused by the air nozzle. The broken yarn component 1, 2, which is wound onto the partially wound spool 10 together with the remaining yarn component 1 or 2, will then have a stronger connection with the remaining yarn component, so that, during a winding-off, it can be withdrawn relatively easily.

Figure 1A:
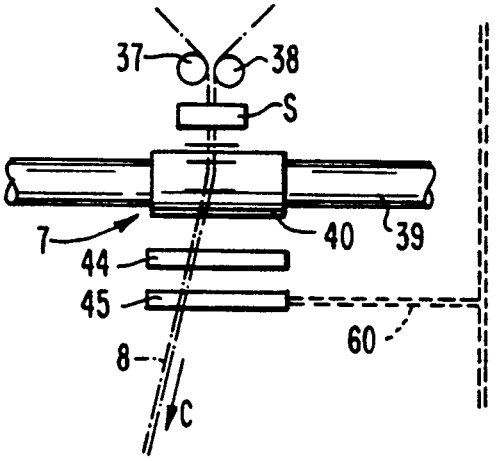
FIG. 1A is a schematic depiction of a portion of the arrangement of FIG. 1, but showing a modified arrangement for securing the broken and intact yarn components together.
Figure 1B:
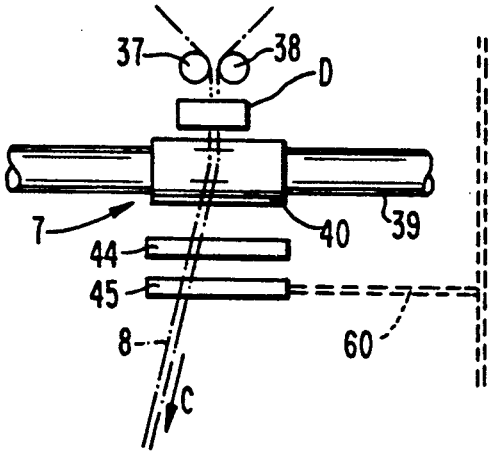
FIG. 1B is a view similar to FIG. 1A, showing yet another embodiment of a device for connecting the yarn components together.
Figure 2:
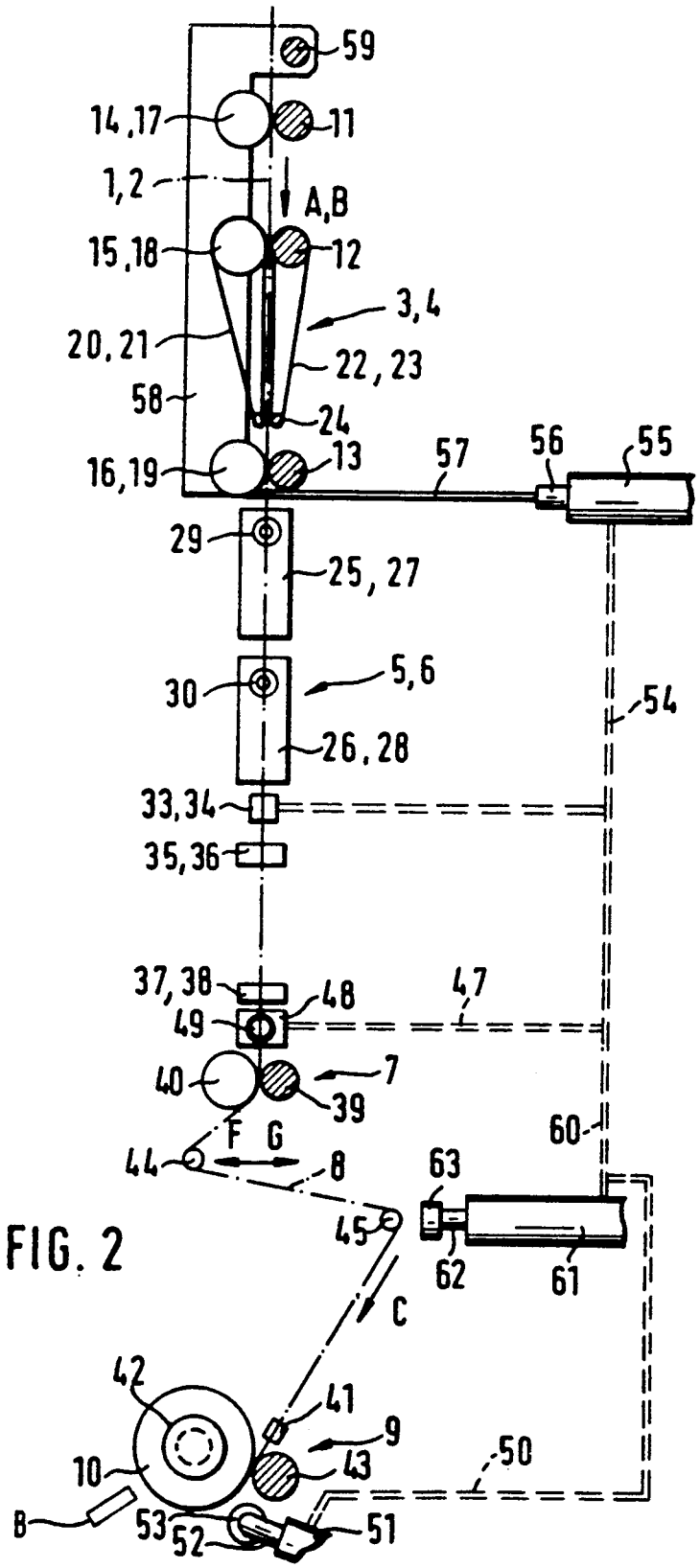
FIG. 2 is a schematic view taken in the direction of arrow II of the arrangement according to FIG. 1.

As indicated by the interrupted line 7, this connecting device 48 may be controlled initially by yarn guards 33, 34, which each, when one of the yarn 1, 2 breaks, activate the corresponding connecting i.e., in the shown embodiment admit compressed air to air nozzle, which may, for example, be controlled by a solenoid valve. Instead of an air nozzle, other false-twisting may also be used, such as crossed aprons, between the yarn components 1, 2 forming the double yarn 8 pass through and which are activated when one of the yarn components 1, 2 breaks. Other connecting devices are also contemplated. It is contemplated, for example, to provide a type of splicing chamber S (FIG. 1A) through which the yarn components 1, 2 pass, which form the double yarn 8, and which, also by means of the yarn guards 33, 34, in the case of a yarn breakage, is activated such that one or several splicing shots are blown into the splicing chamber. It is also contemplated to connect the two yarn components 1, 2 with one another by means of a connecting device D (FIG. 1B) which applies a bonding medium in the form of an adhesive, a strip or a mechanical clip or the like. In all these cases, the connection between the two yarn components 1, 2 is increased so that, when the remaining yarn component is wound off the partially wound spool package 10, the torn or broken yarn component 1, 2 is also wound off.

However, in many cases it will not be necessary to provide additional connections between the two yarn components 1, 2 which form the double yarn. Particularly, when the yarn components 1, 2 are relatively hairy, a sufficient connection is obtained between them which permits a withdrawal of the broken yarn component by means of a winding-off of the unbroken yarn component 1, 2. In this case, it is contemplated to only press together the yarn components 1, 2 in the connecting device 48, if a breakage occurs in one yarn component 1, 2, so that they rest closely against one another and are pressed against one another. This is also controlled by the yarn guards 33, 34. Under certain circumstances, this task of the pressing-together may also be taken over by the correspondingly arranged yarn guides 37, 38, of which one will then be movably arranged in such a manner that it can be pressed against the other one.

Figure 4:
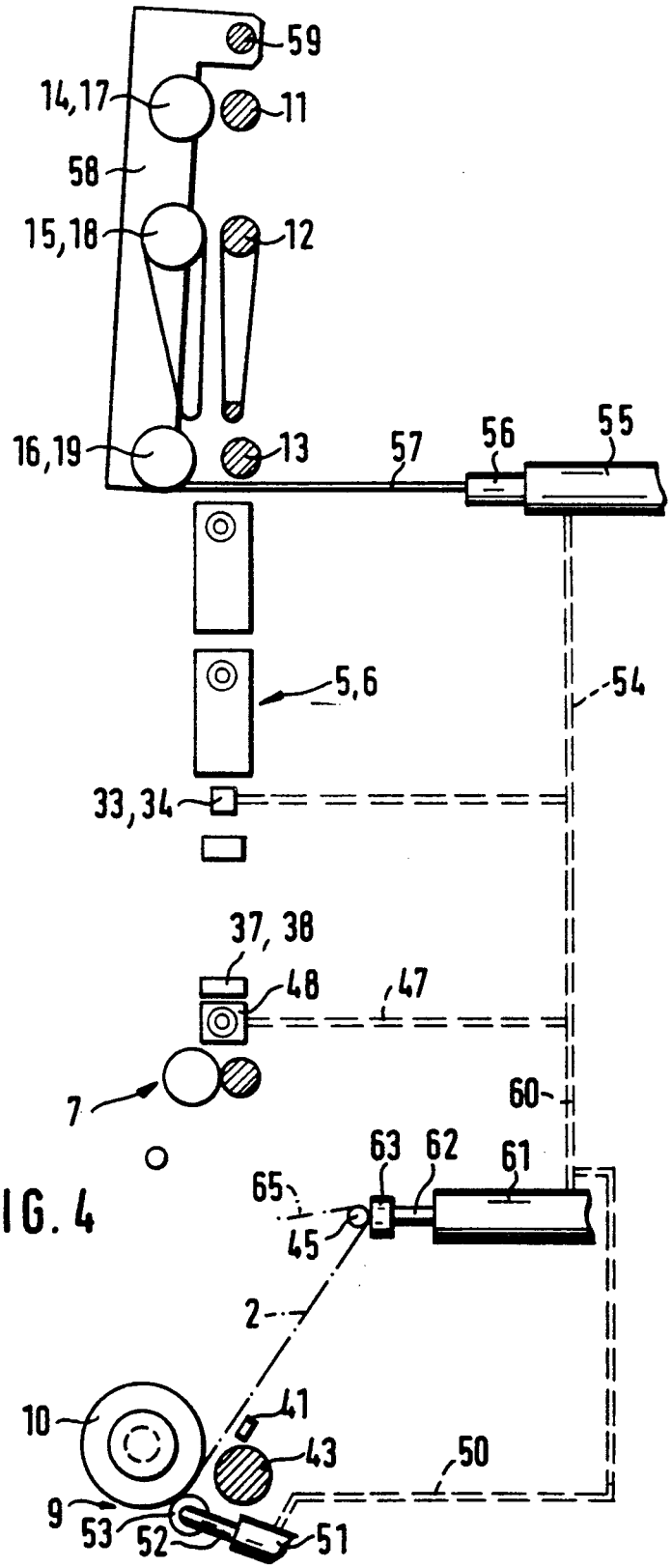
FIG. 4 is a lateral view corresponding to FIG. 2 of the arrangement, showing the arrangement after the stoppage of the partially wound spool and the securing of the remaining yarn component.

A lift-off device is assigned to the spool 10 and consists of a pneumatic cylinder 51, out of which a piston 52 can be moved, which at its end located opposite the spool 10, is equipped with a lift-off roller 53. When one of the two yarn components 1, 2 breaks, the moving-out of the piston 52 is controlled by means of the yarn guards 33, 34. As shown in FIG. 4, it is also achieved by the lifting of the partially wound spool package 10 off its wind-up roller 43 that the yarn component or components 1, 2 are lifted out of the cross-winding yarn guide 41. In order to achieve a stopping of the partially wound spool package 10 that is as fast as possible, braking devices B (FIG. 2) may be provided, which are not shown in detail and which are applied simultaneously to the partially wound spool package 10 or a spool shell onto which the double yarn 8 is wound for forming the package 10.

The yarn guards 33, 34 also control a device for interrupting the sliver supply and thus the whole spinning operation which is, in each case, activated when one of the yarn components 1, 2 breaks. The load carrier 58 is connected via a transmission rod 57 with the piston 56 of a pneumatic cylinder 55. When one of the yarn components 1, 2 breaks, the load carrier 58, with a given delay, which will be explained below, is swivelled around its shaft 59 so that the two drafting units 3, 4 are opened up and thus the sliver supply is interrupted. In a manner not shown in detail, suction devices are assigned to the drafting units 3, 4, the suction devices, in each case, following the pairs of delivery rollers and, when one yarn component breaks, sucking off the continuously entering fiber material. In addition, or as an alternative, suction devices may also be arranged behind the air nozzles 25 to 28, in a similar manner.

Figure 3:
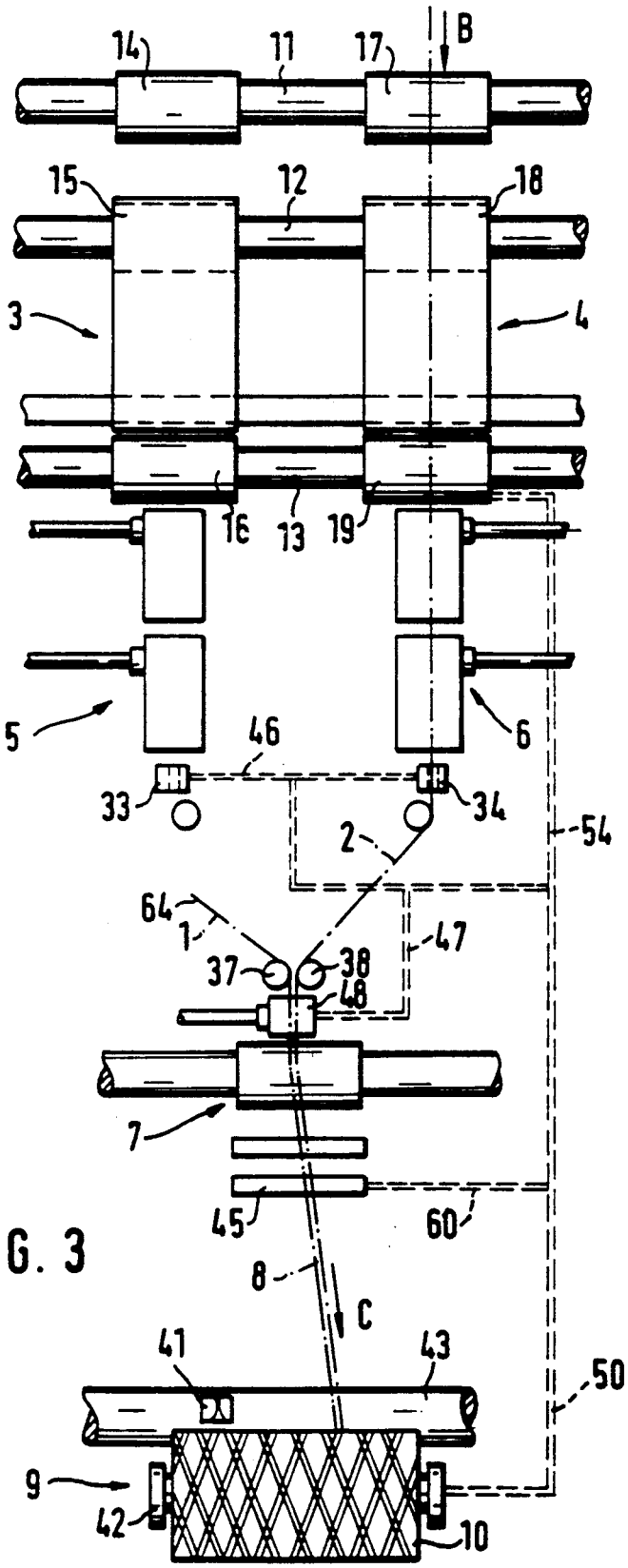
FIG. 3 is a view corresponding to FIG. 1, showing the arrangement after the occurrence of a breakage of one yarn component.

The yarn guards 33, 34 control another control element 61, which is also constructed as a pneumatic cylinder and has a piston 62 which, at its end, carries a yarn clamp 63. The piston 62 with the yarn clamp 63 can be applied to the deflection 45. FIG. 3 that, for example, yarn component 1 broke behind the air nozzles 25, 26 and, with its end 64, has left the yarn guard 33. The yarn guard 33 has then already activated the connecting device 48, i.e., the false-twisting device, so that yarn component 1 is wound around yarn component 2. The yarn guard 33 has also activated the lift-off device of the partially wound spool 10; i.e., the piston 52 with the lift-off roller 53 was moved out. The partially wound spool package 10 runs down and in the process continues to wind up the double yarn 8. Since the double yarn 8 was lifted out of the cross-winding yarn guide 41, it is wound onto the running-down partially wound spool package 10 without any cross-winding. The yarn guard 33 also exercises its control in that the spinning operation is interrupted by opening-up the drafting units 3, 4 by the swivelling-away of the load carrier 58 with the pressure rollers 14 to 19. The interrupting of the spinning operation, as a function of the running-down partially wound spool package 10 is controlled such that the hitherto remaining yarn component 2, which also breaks during the interruption of the spinning operation, is not completely wound onto the partially wound spool package 10. This means that the interruption of the spinning operation will not take place before the partially wound spool package 10 has come to almost a standstill or has come to a complete standstill. This may be ensured by means of a time control. It is also contemplated to monitor the rotation of the partially wound spool package 10 directly, for example, by means of a rotational-speed indicator connected with the lift-off roller 53, this rotational-speed indicator also being connected with the control apparatus. Expediently, the interruption of the spinning process takes place such that the end 65, which during the interruption, is created at the yarn component, which had not broken but will then be breaking, has left the air nozzles 25 to 28 and the withdrawal device 7.

The remaining yarn component 2 (FIG. 4), after the stoppage of the partially wound spool 10, will be fixed in that, controlled by the yarn guard 33 or the control apparatus, the yarn clamp 63 is applied to the deflecting guide 45 and the yarn component 2 is clamped fast. Since the withdrawal device 7 will then continue to run, the end 65 of this yarn component 2 is moved out of the withdrawal device 7. In the case of this embodiment, the clamping-fast of the yarn component 2 must be coordinated as exactly as possible to that point in time at which the partially wound spool package 10 comes to a standstill. It must be reliably prevented that the clamping-fast takes place too early since then the continuously running partially wound spool package 10 may also tear yarn component 2.

Figure 5:
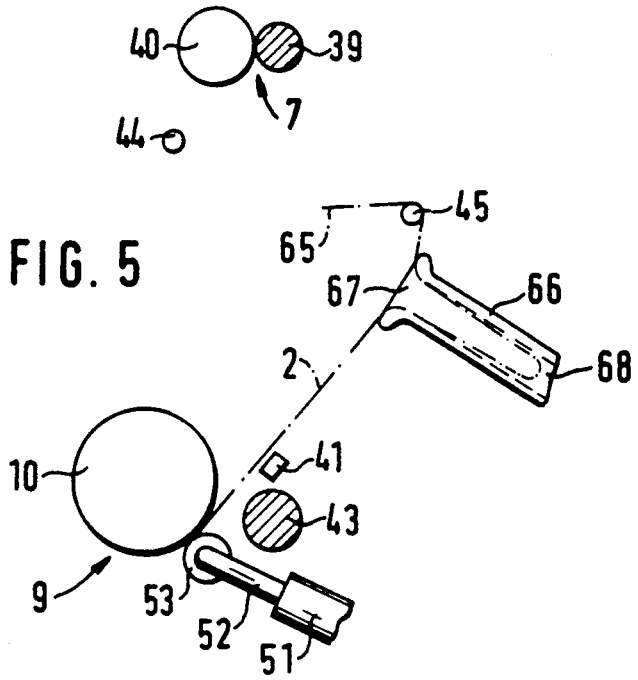
FIG. 5 is a schematic partial view of a detail of another embodiment similar to FIG. 4.
Figure 6:
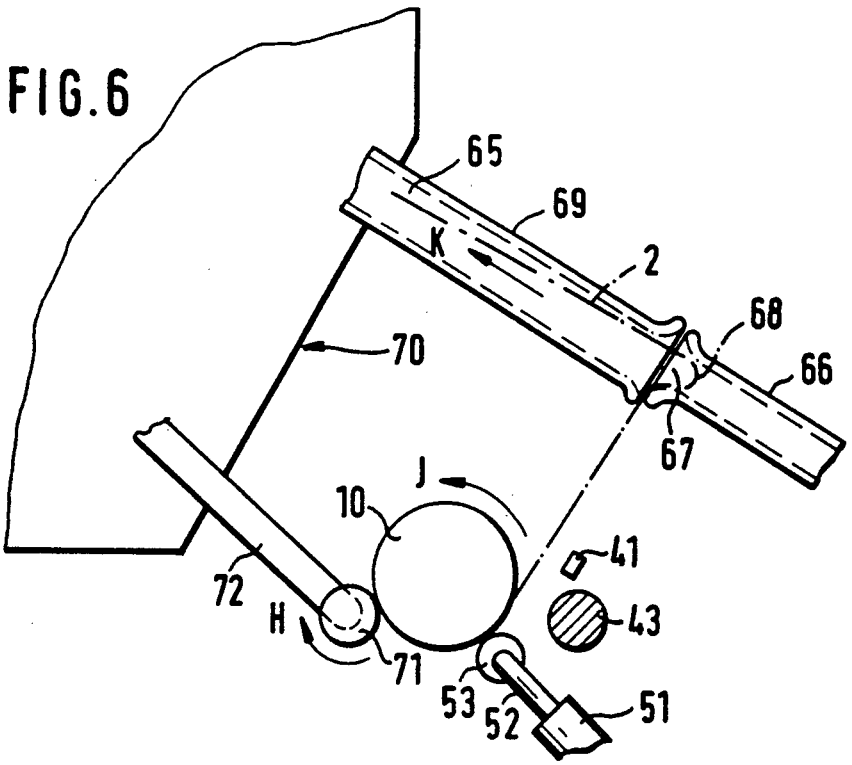
FIG. 6 is a view schematically depicting the embodiment according to FIG. 5 in connection with a servicing device, which is applied to the arrangement and which winds the double yarn off the partially wound spool for a piecing operation.

In the embodiment according to FIG. 5 and 6, as a modification of the embodiment according to FIG. 1 to 4, instead of a clamping device 61 to 63, a suction nozzle 66 is provided which is arranged behind the deflecting guide 45. This suction nozzle 66 faces the course of the yarn by means of a mouth 67. When one yarn component breaks—in the 25 embodiment, it is yarn component 1—this suction nozzle 66 is activated by means of the yarn guard 33. The suction nozzle 66 takes in yarn component 2 in the form of a sucked-in yarn loop 68 as soon as the partially wound spool package 10 slows down, but yarn component 2 continues to be supplied at an unchanged speed. As soon as the end 65 of yarn component 2 has left withdrawal device 7, this end 65 is also sucked into the suction nozzle 66. The time-related coordination of the switching-on of the suction nozzle 66 serving as the holding device is thus easier than the time-related coordination of the clamping device 61, 62, 63 of the embodiment according to FIG. 1 to 4.

In both embodiments, the arrangement is stopped in such a manner that, when one yarn component breaks, the remaining yarn component is kept ready at a defined point and is not wound onto the partially wound spool package 10. It is relatively easy for an automatic piecing device to take up this yarn component at the defined point and then, while driving the partially wound spool package 10 in wind-off direction, withdraw it from the partially wound spool package 10. The unbroken yarn component 2 is connected such with the broken yarn component 1 that a withdrawal of yarn component 2 has the result that also yarn component 1 is taken off the partially wound spool package 10 and is also withdrawn. As soon as both yarn components 1, 2 have been sufficiently wound off the partially wound spool package 10, they may be used for a piecing operation during which they are connected with the yarn components coming from the drafting units 3, 4 after a restarting of the spinning operation.

FIG. 6 shows schematically which devices a piecing device 70 must have in order to implement the taking-up and the withdrawing of both yarn components 1, 2 from a partially wound spool package 10. The piecing arrangement 70 is equipped with a wind-off roller 71, which is arranged on an arm 72, which can be applied to the partially wound spool package 10, this wind-off roller 71 being drivable in the direction of arrow (H) and in the process, driving the partially wound spool package 10, which is supported by the lift-off roller 53, in wind-off direction (I). A suction gripper 69 of the servicing device 70 is applied to the mouth 67 of the suction nozzle 66, this suction gripper 69 sucking in the yarn component 2 in the direction of arrow (K). The taking-in of the yarn component 2 and the winding-off from the partially wound spool package 10 is continued until the piecing arrangement 70 has taken over both yarn components 1, 2. This may, for example, be determined by means of a corresponding optical, electronic or mechanical yarn guard of the piecing arrangement 70. In practice, it may, however, also be sufficient for the wind-off operation to be continued over a period of time which is so long that it can be assumed with sufficient certainty that the double yarn 8 was wound off and has entered into the piecing device 70.

As mentioned above, the invention is based on the assumption that both yarn components 1, 2 break simultaneously only in very rare cases. In this case, both yarn components 1, 2 are wound onto the partially wound spool package 10 so that the broken ends of both yarn components 1, 2 will then be located on the partially wound spool package 10. These ends will then be located at the same point and can also be found relatively easily. Since this case of a simultaneous breaking of both yarn components 1, 2 occurs relatively rarely, it may be provided that in this case a piecing is made possible only by means of additional manual operations.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A process for piecing double yarn at a spinning unit which includes drafting means and false twisting means for forming two separate prestrengthened yarn components and package wind-up means for winding up the two yarn components in an untwisted side-by-side relationship as a double yarn on a double yarn package, said process including the sequential steps of:

interrupting the operation of the package wind-up means upon the occurrence of a break in one of the yarn components while the other yarn component remains intact, gripping the other intact yarn component and holding the same at a predetermined location, withdrawing the intact yarn component from the package with the broken yarn component on the package being also removed with the intact yarn component due to disposition of the two yarn components side-by-side on the package, and piecing the yarn components removed from the package with respective yarn components being spun at the spinning unit.

2. A process for piecing double yarn at a spinning unit according to claim 1, wherein said package wind-up means includes crosswinding means for controlling crosswinding of the two yarn components on the double yarn package, and wherein said crosswinding means is deactivated upon the occurrence of a break in one of the yarn components, to thereby prevent the crosswinding means from separating the end of the broken yarn component from the intact yarn component.

3. A process for piecing double yarn at a spinning unit which includes drafting means and false twisting means for forming two separate prestrengthened yarn components and package wind-up means for winding up the two yarn components side-by-side as a double yarn on a double yarn package, said process including the sequential steps of:

interrupting the operation of the package wind-up means upon the occurrence of a break in one of the yarn components while the other yarn component remains intact, gripping the other intact yarn component and holding the same at a predetermined location, withdrawing the intact yarn component from the package with the broken yarn component on the package being also removed with the intact yarn component due to disposition of the two yarn components side-by-side on the package, piecing the yarn components removed from the package with respective yarn components being spun at the spinning unit, and connecting the broken yarn component with the intact yarn component, prior to said step of withdrawing, so that the yarn components are more closely connected as they are wound into the package than they are during normal winding operations.

4. A process for piecing double yarn at a spinning unit according to claim 3, wherein said package wind-up means includes crosswinding means for controlling crosswinding of the two yarn components on the double yarn package, and wherein said crosswinding means is deactivated upon the occurrence of a break in one of the yarn components, to thereby prevent the crosswinding means from separating the end of the broken yarn component from the intact yarn component.

5. A process for piecing double yarn at a spinning unit which includes drafting means and false twisting means for forming two separate prestrengthened yarn components and package wind-up means for winding up the two yarn components side-by-side as a double yarn on a double yarn package, said process including the sequential steps of:

interrupting the operation of the package wind-up means upon the occurrence of a break in one of the yarn components while the other yarn component remains intact, connecting the broken yarn component with the intact yarn component so that they are more closely connected as they are wound onto the package than they are during normal winding operations, withdrawing the intact yarn component from the predetermined location and withdrawing the intact yarn component from the package with the broken yarn component on the package being also removed with the intact yarn component due to connection of the two yarn components, and piecing the yarn components removed from the package with respective yarn components being spun at the spinning unit.

6. A process for piecing double yarn at a spinning unit according to claim 5, wherein said package wind-up means includes crosswinding means for controlling crosswinding of the two yarn components on the double yarn package, and wherein said crosswinding means is deactivated upon the occurrence of a break in one of the yarn components, to thereby prevent the crosswinding means from separating the end of the broken yarn component from the intact yarn component.

7. Apparatus for piecing double yarn at a spinning unit which includes drafting means and false twisting means for forming two separate prestrengthened yarn components and package wind-up means for winding up the two yarn components in an untwisted side-by-side relationship as a double yarn on a double yarn package, said apparatus including:

wind-up interrupting means for interrupting the operation of the package wind-up means upon the occurrence of a break in one of the yarn components while the other yarn component remains intact, intact yarn gripping means for gripping the other intact yarn component and holding the same at a predetermined location, intact yarn withdrawing means for withdrawing the intact yarn component from the package with the broken yarn component on the package being also removed with the intact yarn component due to disposition of the two yarn components side-by-side on the package, and piecing means for piecing the yarn components removed from the package with respective yarn components being spun at the spinning unit.

8. Apparatus for piecing double yarn at a spinning unit according to claim 7, wherein said package wind-up means includes crosswinding means for controlling crosswinding of the two yarn components on the double yarn package, and wherein said crosswinding means is deactivated upon the occurrence of a break in one of the yarn components, to thereby prevent the crosswinding means from separating the end of the broken yarn component from the intact yarn component.

9. Apparatus for piecing double yarn at a spinning unit which includes drafting means and a false twisting means for forming two separate prestrengthened yarn components and package wind-up means for winding up the two yarn components side-by-side as a double yarn on a double yarn package, said apparatus including:

wind-up interrupting means for interrupting the operation of the package wind-up means upon the occurrence of a break in one of the yarn components while the other yarn component remains intact, intact yarn gripping means for gripping the other intact yarn component and holding the same at a predetermined location, intact yarn withdrawing means for withdrawing the intact yarn component from the package with the broken yarn component on the package being also removed with the intact yarn component due to disposition of the two yarn components side-by-side on the package, piecing means for piecing the yarn components removed from the package with respective yarn components being spun at the spinning unit, and broken yarn component connecting means for connecting the broken yarn component with the intact yarn component, prior to said step of withdrawing, so that the yarn components are more closely connected as they are wound into the package than they are during normal winding operation.

10. Apparatus for piecing double yarn at a spinning unit according to claim 9, wherein said package wind-up means includes crosswinding means for controlling crosswinding of the two yarn components on the double yarn package, and wherein said crosswinding means is deactivated upon the occurrence of a break in one of the yarn components, to thereby prevent the crosswinding means from separating the end of the broken yarn component from the intact yarn component.

11. Apparatus for piecing double yarn at a spinning unit according to claim 9, wherein the intact yarn gripping means are arranged behind guiding means for guiding together the yarn components in the travel direction of the two yarn components.

12. Apparatus for piecing double yarn at a spinning unit according to claim 11, wherein the intact yarn gripping means includes a clamping device for clamping the yarn components.

13. Apparatus for piecing double yarn at a spinning unit according to claim 12, further comprising yarn component connecting means, said yarn component connecting means being disposed downstream of guiding means for guiding together the yarn components.

14. Apparatus for piecing double yarn at a spinning unit according to claim 11, wherein the intact yarn gripping means includes at least one suction nozzle.

15. Apparatus for piecing double yarn at a spinning unit according to claim 14, further comprising yarn component connecting means, said yarn component connecting means being disposed downstream of guiding means for guiding together the yarn components.

16. Apparatus for piecing double yarn at a spinning unit according to claim 11, wherein said package wind-up means includes crosswinding means for controlling crosswinding of the two yarn components on the double yarn package, and wherein said crosswinding means is deactivated upon the occurrence of a break in one of the yarn components, to thereby prevent the crosswinding means from separating the end of the broken yarn component from the intact yarn component.

17. Apparatus for piecing double yarn at a spinning unit according to claim 9, wherein the wind-up interrupting means includes package lift off means for the lifting of a partially wound spool package off a driving device of the wind-up means.

18. Apparatus for piecing double yarn at a spinning unit according to claim 17, wherein the wind-up interrupting means includes spool package braking means for braking of the partially wound spool package.

19. Apparatus for piecing double yarn at a spinning unit according to claim 18, further comprising yarn component connecting means, said yarn component connecting means being disposed downstream of guiding means for guiding together the yarn components.

20. Apparatus for piecing double yarn at a spinning unit according to claim 17, further comprising yarn component connecting means, said yarn component connecting means being disposed downstream of guiding means for guiding together the yarn components.

21. Apparatus for piecing double yarn at a spinning unit according to claim 9, wherein the wind-up interrupting means includes cross-winding device means for cross-winding the yarn components on the spool package, and wherein the wind-up interrupting means includes devices for lifting a yarn component out of cross-winding device means of the wind-up means.

22. Apparatus for piecing double yarn at a spinning unit according to claim 9, further comprising yarn component connecting means, said yarn component connecting means being disposed downstream of guiding means for guiding together the two yarn components.

23. Apparatus for piecing double yarn at a spinning unit according to claim 22, wherein the yarn component connecting means is controlled by yarn component monitoring means.

24. Apparatus for piecing double yarn at a spinning unit according to claim 23, wherein the yarn component connecting means are constructed as a twisting nozzle.

25. Apparatus for piecing double yarn at a spinning unit according to claim 23, wherein the yarn component connecting means are constructed as a splicing device.

26. Apparatus for piecing double yarn at a spinning unit according to claim 22, wherein the yarn component means are constructed as a twisting nozzle.

27. Apparatus for piecing double yarn at a spinning unit according to claim 22, wherein the yarn component connecting means are constructed as a splicing device.

28. Apparatus for piecing double yarn at a spinning unit which includes drafting means and false twisting means for forming two separate prestrengthened yarn components and package wind-up means for winding up the two yarn components side-by-side as a double yarn on a double yarn package, said apparatus including:

wind-up interrupting means for interrupting the operation of the package wind-up means upon the occurrence of a break in one of the yarn components while the other yarn component remains intact, yarn component connecting means for connecting the broken yarn component with the intact yarn component so that they are more closely connected as they are wound onto the package than they are during normal winding operations, intact yarn withdrawing means for withdrawing the intact yarn component from the package with the broken yarn component on the package being also removed with the intact yarn component due at least in part to connection of the two yarn components by the yarn component connecting means, and piecing means for piecing the yarn components removed from the package with respective yarn components being spun at the spinning unit.

* * * * *